US005691807A

United States Patent [19]

Fuei et al.

[11] Patent Number: 5,691,807

[45] Date of Patent: Nov. 25, 1997

[54] PROCESS CARTRIDGE AND IMAGE FORMING APPARATUS WITH INDICATING MEANS

[75] Inventors: Naoki Fuei, Kawaguchi; Mahito Yoshioka, Yokohama, both of Japan

[73] Assignee: Canon Kabushiki Kaisha, Tokyo, Japan

[21] Appl. No.: 605,713

[22] Filed: Feb. 22, 1996

Related U.S. Application Data

[63] Continuation of Ser. No. 472,059, Jun. 5, 1995, abandoned, which is a continuation of Ser. No. 347,179, Nov. 22, 1994, abandoned, which is a continuation of Ser. No. 38,899, Mar. 29, 1993, abandoned.

[30] Foreign Application Priority Data

Oct. 22, 1992 [JP] Japan ..... 4-308043

[51] Int. Cl.[6] ..... G03G 21/18; G03G 15/02

[52] U.S. Cl. ..... 355/210; 355/219; 355/245; 355/296

[58] Field of Search ..... 355/200, 210, 355/211, 219, 245, 251, 259, 296, 301

[56] References Cited

U.S. PATENT DOCUMENTS 4,551,000 11/1985 Kanemitsu et al. .

FOREIGN PATENT DOCUMENTS 4-136866 5/1992 Japan .

*Primary Examiner*—R. L. Moses

*Attorney, Agent, or Firm*—Fitzpatrick, Cella, Harper & Scinto

[57] ABSTRACT

The present invention provides a process cartridge mountable within an image forming apparatus, comprising a frame, and process means provided within the frame and adapted to contribute an image formation, wherein an indicating means for indicating the number of usages is provided on a shaft of a reusable part among parts to be used with the process means. Further, the present invention also provides an image forming apparatus within which a process cartridge can removably be mounted and which forms an image on a recording medium, comprising a mounting means capable of mounting a process cartridge including a frame and process means provided within the frame and adapted to contribute an image formation, wherein an indicating means for informing the number of usages is provided on a shaft of a reusable part among parts to be used with the process means, a transfer means for transferring an image formed on an image bearing member included in the process cartridge mounted on the mounting means onto the recording medium, and a convey means for conveying the recording medium.

In this way, in the present invention, since the indicating means is provided on the shaft of the reusable part, it is possible to maintain the informing ability of the indicating means without deteriorating the function of the part due to the provision of the indicating means, and to easily recognize the number of usages of the part even when the part is dismounted from the associated unit.

68 Claims, 8 Drawing Sheets

PROCESS CARTRIDGE AND IMAGE FORMING APPARATUS WITH INDICATING MEANS

This application is a continuation of application Ser. No. 08/472,059, filed Jun. 5, 1995, which is a continuation of application Ser. No. 08/347,179, filed Nov. 22, 1994, which is a continuation of application Ser. No. 08/038,899, filed Mar. 29, 1993, all now abandoned.

BACKGROUND OF THE INVENTION

1. Field of the Invention

The present invention relates to an image forming apparatus for forming an image on a recording medium, and a process cartridge used with such image forming apparatus. Such image forming apparatus may include a laser beam printer, an LED printer, an electrophotographic copying machine, a facsimile system and the like.

2. Related Background Art

Now, while an example of a process cartridge and an image forming apparatus within which such process cartridge can be mounted will be explained, it should be noted that the present invention is not limited to such example but may be applied to an image forming apparatus having no process cartridge, for example.

By the way, an image forming apparatus such as a printer and the like is so designed that a latent image is formed on a uniformly charged image bearing member by selectively exposing the image bearing member in response to image information; the latent image so formed is then visualized with toner as a toner image, and the toner image is transferred onto a recording medium, thereby forming an image. In such an image forming apparatus, whenever the toner is used up, new toner must be replenished; the frequent replenishment of the toner is very troublesome and sometimes causes contamination. Further, since the maintenance of various parts of the image forming apparatus can be performed only by expert service men, the users often feel inconvenience.

To avoid this, there has been proposed a cartridge wherein the image bearing member, a charger, a developing device, a cleaning device and the like are integrally incorporated as a unit which can be removably mounted within an image forming apparatus by the operator, thereby facilitating the replenishment of toner, the exchange of parts, such as the image bearing member, which have been damaged or worn up, and the maintenance.

In the past, such cartridges were dumped when the toner in the cartridge was used up. Thus, any re-usable parts such as various rollers were also dumped together with the cartridge. However, recently, in various electric and electronic equipment, units including the damaged or worn parts have been collected, instead of being dumped, for recycling and re-using such units, for the purpose of the saving of resources and energy, and for the reduction of dumped matters in consideration of the protection of the global environment.

For example, screws and gears used in the cartridge have been collected and re-used. Further, the plastic material from which a cover of the cartridge is made was molten and was used as material for molding a cover of a new cartridge. Further, aluminium material from which the cartridge is made was also molten and was re-used as aluminium material for forming any parts.

However, regarding function parts, since it is very difficult to judge or determine whether the service life of a function part has been expired or not, such function parts were not recycled in the past. Now, a function part refers to a part that the electrical or optical function thereof can be maintained for a given time duration. For example, in a process cartridge, a charger roller, developing sleeve and cleaning roller can be considered as the function parts, and in an image forming apparatus, a transfer roller, fixing rollers and convey rollers can be considered as the function parts.

Since the above-mentioned function parts such as the rollers have long service lives, even when the toner in the cartridge has been used up or consumed completely, such function parts can be used as they are. From a point of view of the protection of the global environment, the re-usable function parts are required to be positively recycled.

In consideration of the above, the inventors proposed the remarkably effective technique wherein information means are provided regarding the re-usable parts to inform the operator of the number of usages of such parts in order to effect the recycle effectively (refer to the Japanese Patent Application No. 2-257133 filed on Sep. 28, 1990 corresponding to the Japanese Patent Application Laid-open No. 4-136866 published on May 11, 1992).

The present invention improves the above-mentioned technique.

SUMMARY OF THE INVENTION

An object of the present invention is to provide a process cartridge and an image forming apparatus which can perform the recycle of parts very effectively.

Another object of the present invention is to provide a process cartridge and an image forming apparatus which can inform of the number of usages of re-usable parts without worsening the abilities of such parts by providing information means for informing the number of usages of the parts on axes of the parts.

A further object of the present invention is to provide a process cartridge and an image forming apparatus which can maintain the ability of the information means without damage of the information means due to the wear thereof by providing the information means for informing the number of usages of re-usages parts on axes of the parts, The other object of the present invention is to provide a process cartridge and an image forming apparatus which can easily discriminate the number of usages of each re-usable part by providing the information means for informing the number of usages of the parts on axes of the parts,

DETAILED DESCRIPTION OF THE PREFERRED EMBODIMENTS

Figure 8:
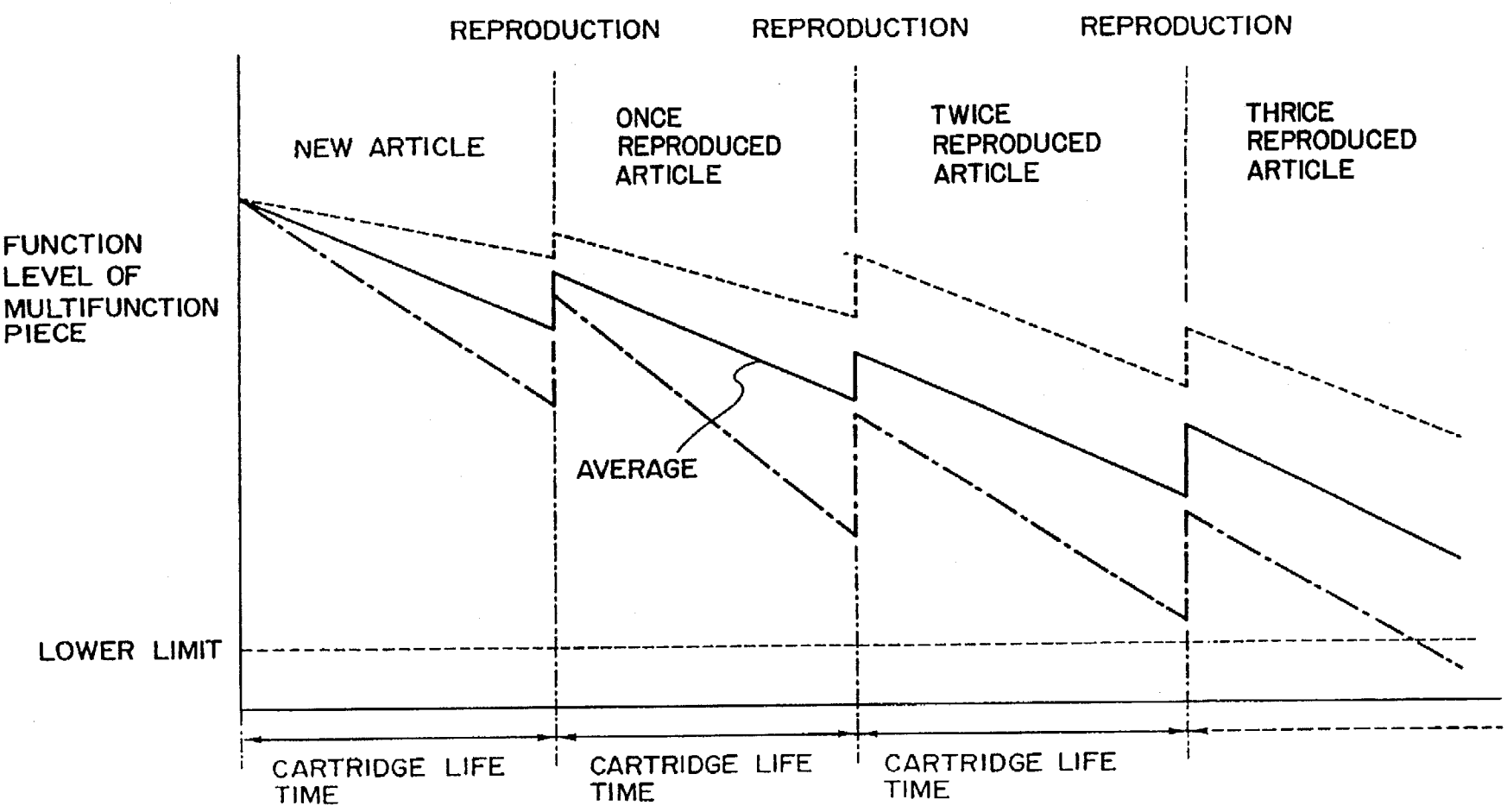
FIG. 8 is a graph showing an example of a relation between service lives of function parts and a service life of a process cartridge.

First of all, prior to the explanation of an embodiment of the present invention, a relation between a service life of a charger roller as a function part or article and a service life of a process cartridge is shown in FIG. 8.

The service life of the process cartridge shown in FIG. 8 permits the image information for about 3,000 copies; on the other hand, rollers as function parts or pieces are incorporated into the process cartridge and have service lives greater than the process cartridge itself by three times or more. Incidentally, in FIG. 8, the broken line shows a roller the function level of which was reduced at the minimum, and the dot and chain line shows a roller the function level of which was reduced at the maximum, and the solid line shows an average of the sample.

The function level of each roller is reduced gradually as the number of copies is increased. This is because the contactibity and the surface smoothness of the roller is deteriorated by adhering of the toner to the peripheral surface of the roller. However, even when the function levels of the rollers are reduced, the rollers can provide their proper functions sufficiently within the service life of the process cartridge itself.

After the used cartridge is collected and the reproducing operation such as cleaning is effected regarding the used rollers, the function levels of such rollers are restored. However, in the example shown in FIG. 8, after the reproducing operations were effected by three times regarding the roller having the lower function level, if such a roller is incorporated into a new process cartridge, it is anticipated that the function level may be decreased below the service life of the process cartridge itself. This is because that the material of the roller has deteriorated for a long time. Thus, for the function pieces such as rollers, the number of recycle usages thereof is determined according to the durability thereof, and, therefore, usage over the durability must be avoided.

Now, a first embodiment of the present invention will be explained.

Under the considerations above, a process cartridge and an image forming apparatus according to a first embodiment of the present invention will be fully described with reference to the accompanying drawings. Incidentally, while the image forming apparatus which will be described below utilizes a process cartridge, it should be noted that the present invention can be applied to any image forming apparatuses having no process cartridge.

Figure 1:
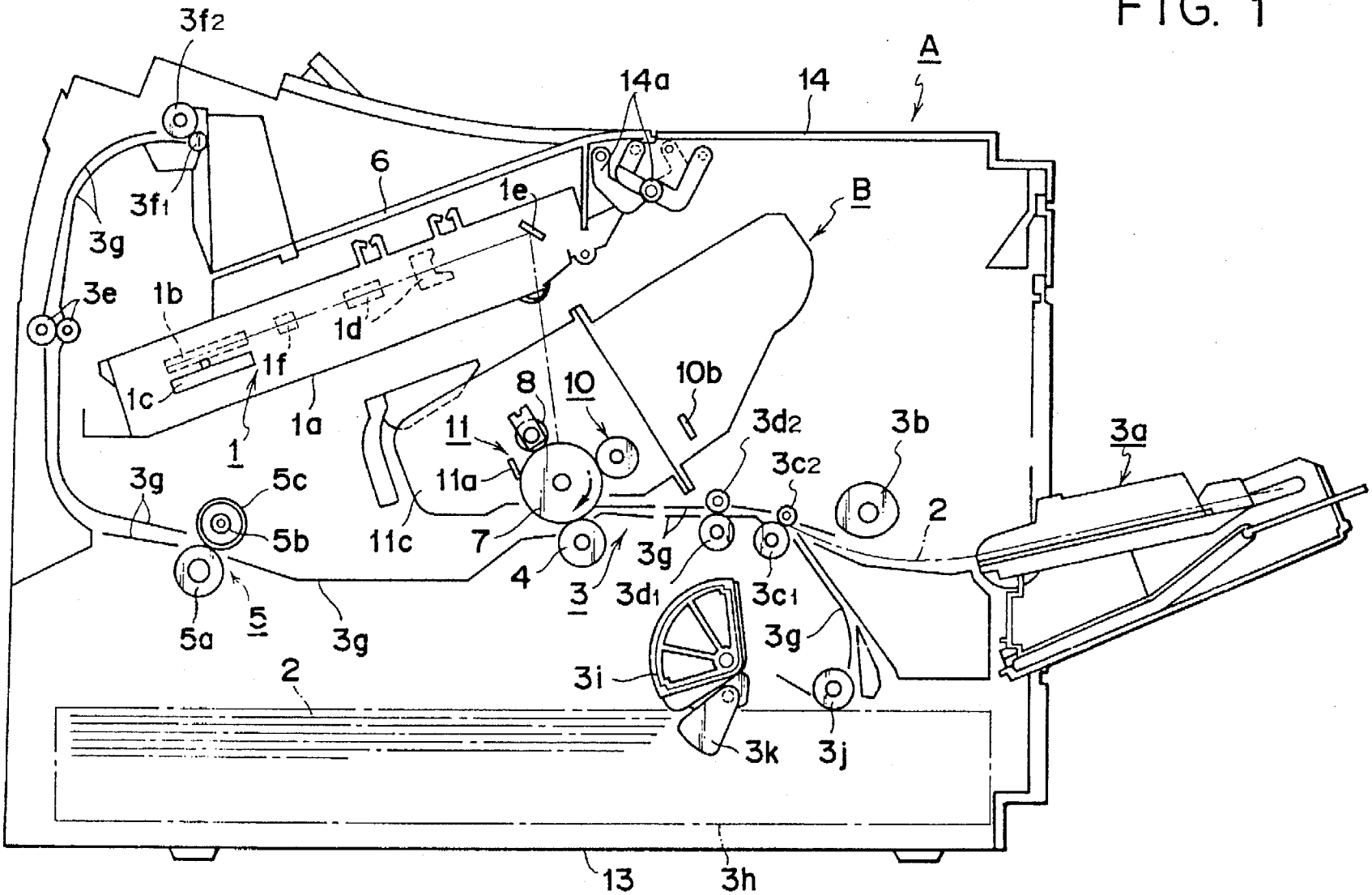
FIG. 1 is an elevational sectional view of an image forming apparatus within which a process cartridge is mounted.

First of all, the whole construction of the image forming apparatus within which the process cartridge is mounted will be explained. FIG. 1 is a sectional view of a laser beam printer as an example of the image forming apparatus, and FIG. 2 is a sectional view of the process cartridge.

As shown in FIG. 1, the image forming apparatus A is designed so that a developer (referred to as "toner" hereinafter) image is formed by developing a latent image formed on a photosensitive drum (image bearing member) by illuminating image light from an optical system 1 in response to image information. Synchronously with the formation of the toner image, a recording medium 2 is fed by a convey means 3 so that the toner image formed on the photosensitive drum at an image forming station in the process cartridge B is transferred onto the recording medium 2 by a transfer means 4. Then, the recording medium 2 is sent to a fixing means 5, where the transferred toner image is permanently fixed to the recording medium. Thereafter, the recording medium is discharged onto a discharge portion 6.

Figure 2:
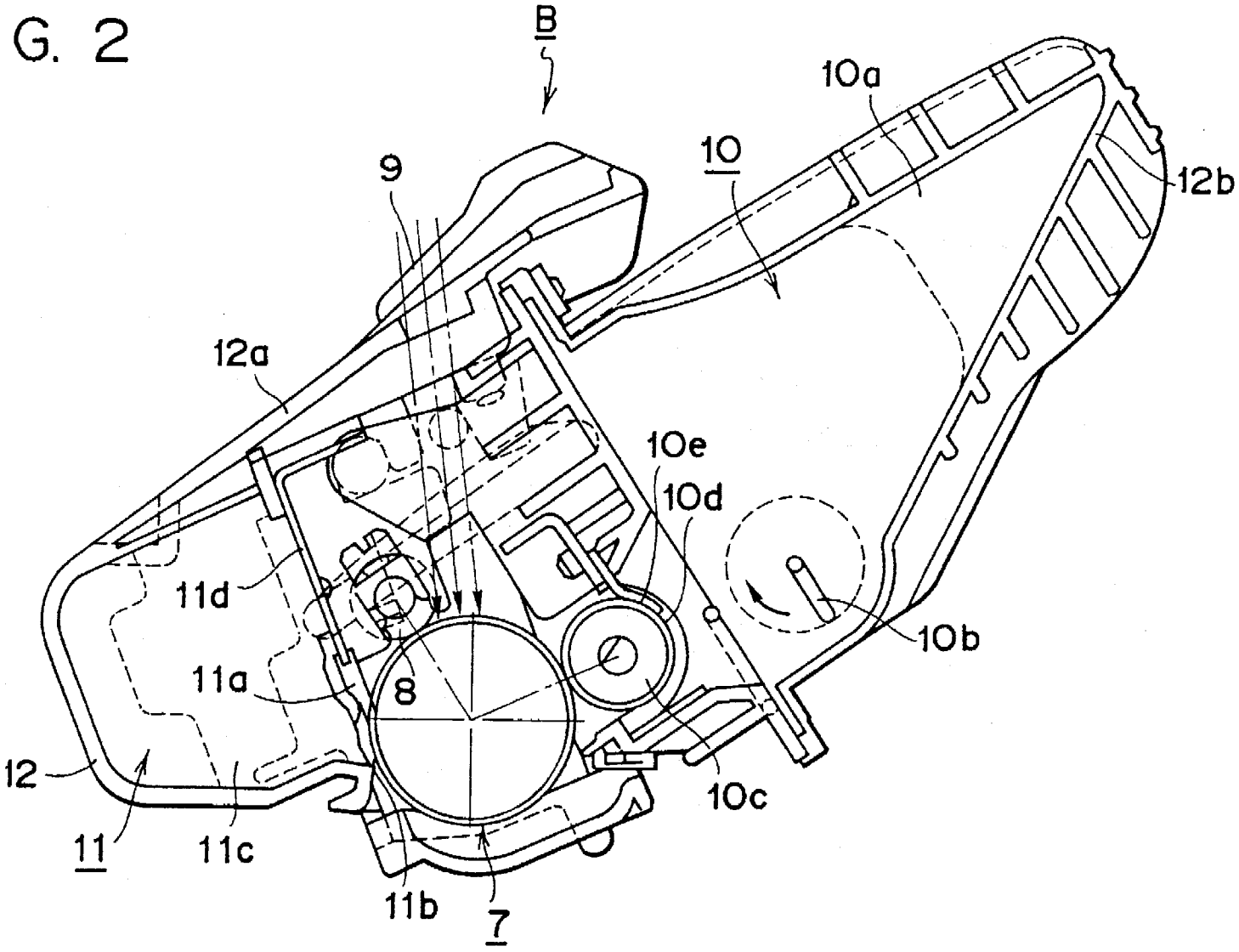
FIG. 2 is a cross-sectional view of the process cartridge.

As shown in FIG. 2, the process cartridge B constituting the image forming station is so designed that the rotating photosensitive drum 7 is uniformly charged by a charger means 8, and then a latent image is formed on the photosensitive drum 7 by exposing the drum at an exposure station 9 with image light from the optical system 1, and then the latent image is developed by a developing means 10 to visualize the latent image as a toner image. After the toner image is transferred onto the recording medium 2 by the transfer means 4, the residual toner remaining on the photosensitive drum 7 is removed by a cleaning means 11. Incidentally, parts such as the photosensitive drum and the like are contained in a frame 12 as a housing so as to form a cartridge.

Next, various constructural elements of the image forming apparatus A and the process cartridge B will be explained.

Image Forming Apparatus

First of all, regarding the image forming apparatus A, the optical system, convey means, transfer means, fixing means and cartridge mounting means will be described in order.

(Optical System)

The optical system 1 serves to illuminate the image light on the photosensitive drum 7 in response to the image information from an external device. As shown in FIG. 1, a laser diode 1*b*, a polygon mirror 1*c*, a scanner motor 1*d*, a focusing lens 1*e* and a reflection mirror if are incorporated into an optical unit 1*a* arranged within a frame 13 of the image forming apparatus A. When an image signal is sent to the image forming apparatus from an external device such as a computer, word processor or the like, the laser diode 1*b* is activated in response to the image signal to emit the image light to the polygon mirror 1*c*. The polygon mirror 1*c* is rotated at a high speed by the scanner motor 1*d* so that the image light reflected by the polygon mirror 1*c* is illuminated on the rotating photosensitive drum 7 through the focusing lens 1*e* and the reflection mirror 1*f*, thereby selectively exposing the surface of the photosensitive drum 7 to form the latent image corresponding to the image information.

(Recording Medium Convey Means)

Next, the convey means 3 for conveying the recording medium 2 (for example, a recording sheet, OHP sheet or thin film) will be described.

In the illustrated embodiment, the recording sheet 2 can be supplied both by the manual insertion and from a sheet supply cassette. As shown in FIG. 1, in the manual insertion mode, one or more recording media 2 are manually set on a sheet supply tray 3*a* and the image formation is started. As a result, a pick-up roller 3*b* is rotated to supply the recording medium 2 on the sheet supply tray 3*a* into the apparatus. When a plurality of recording media 2 are set on the tray, the recording media are separated one by one by a pair of separation rollers 3*c*1, 3*c*2. The recording medium 2 is supplied until a leading end of the recording medium is abutted against a nip between a pair of regist rollers 3*d*1, 3*d*2. The paired regist rollers 3*d*1, 3*d*2 are rotated in response to the image forming operation to convey the recording medium 2 to the image forming station. The recording medium 2 on which the image was formed is sent to the fixing means 5, and then the recording medium is discharged on the discharge portion 6 by a pair of intermediate discharge rollers 3*e* and a pair of discharge rollers 3*f*1, 3*f*2. Incidentally, between the roller pairs, there are disposed guide members 3*g*, and the sheet supply tray 3*a* serves to act as a cover when it is not used.

On the other hand, as shown in FIG. 1, when the recording medium is to be supplied from a sheet supply cassette, a sheet supply cassette 3*h* is inserted into a cassette mounting portion formed at a lower portion of the frame 13 of the apparatus. When the recording medium 2 is not manually supplied, the recording medium 2 is supplied one by one from the sheet supply cassette 3*h* (from uppermost one on the stack) by a pick-up roller 3*i* and a feed roller 3*j* to reach the pair of regist rollers 3*d*1, 3*d*2. Thereafter, the recording medium is conveyed in the same manner as in the manual insertion mode. Incidentally, a sensor 3*k* serves to detect the presence/absence of the recording medium 2 in the sheet supply cassette 3*h*.

(Transfer Means)

The transfer means 4 serves to transfer the toner image formed on the photosensitive drum 7 onto the recording medium 2. In the illustrated embodiment, as shown in FIG. 1, the transfer means 4 comprises a transfer roller 4. That is, the recording medium 2 is urged against the photosensitive drum 7 in the process cartridge B inserted into the image forming apparatus by the transfer roller 4, and by applying the voltage having the polarity opposite to that of the toner image to the transfer roller 4, the toner image on the photosensitive drum 7 is transferred to the recording medium 2.

(Fixing Means)

The fixing means 5 serves to fix the toner image transferred to the recording medium by the transfer roller 4 to the recording medium 2. As shown in FIG. 1, the fixing the means comprises a drive roller 5*a*, and a driven fixing roller 5*c* having a heater 5*b* therein and urged against the drive roller 5*a*. That is, while the recording medium 2 to which the toner image was transferred at the transfer station is being passed through a nip between the drive roller 5*a* and the fixing roller 5*c*, the toner image is permanently fixed to the recording medium 2 by pressure between the rollers and heat from the fixing roller 5*c*.

(Process Cartridge Mounting Means)

A cartridge mounting means for mounting the process cartridge B is provided within the image forming apparatus A. The mounting and dismounting of the process cartridge B with respect to the frame 13 of the apparatus is effected after a cover 14 is opened. That is, the opening/closing cover 14 is pivotally mounted on an upper portion of the frame via a hinge 14*a*. When the cover 14 is opened, a cartridge mounting space in the frame 13 is exposed to the operator. Left and right guide members (not shown) are formed on left and right side walls of the frame. The guide members have guide portions along which the process cartridge B is inserted into the frame. Thus, the process cartridge B can be mounted within the image forming apparatus A by inserting the process cartridge B along the guide portions and closing the cover 14.

Process Cartridge

Next, parts of the process cartridge B to be mounted within the image forming apparatus A will be explained.

The process cartridge B includes an image bearing member and at least one process means. The process means may include, for example, a charger means for charging the surface of the image bearing member, a developing means for forming a toner image on the image bearing member, a cleaning means for removing the residual toner from the image bearing member, and the like. In the illustrated embodiment, as shown in FIG. 2, the process cartridge B comprises first and second frames 12*a*, 12*b* constituting the frame 12 within which the charger means 8, exposure station 9, developing means 10 and cleaning means 11 are arranged around the electrophotographic photosensitive drum 7 as an image bearing member, thereby providing a unit which can be removably mounted within the frame 13 of the apparatus.

Next, the photosensitive drum 7, charger means 8, exposure station 9, developing means 10 and cleaning means 11 of the process cartridge B will be explained in order.

(Photosensitive Drum)

The photosensitive drum according to this embodiment comprises a cylindrical aluminium drum core and an organic photosensitive layer coated around the drum core. The photosensitive drum 7 is rotatably attached to the frame 12, and the photosensitive drum 7 is rotated in a direction shown by the arrow in FIG. 1 in response to the image forming operation by transmitting a driving force of a drive motor of the image forming apparatus to the photosensitive drum via a gear (not shown) secured to one end of the drum.

(Charger Means)

The charger means serves to uniformly charge the surface of the photosensitive drum 7. In the illustrated embodiment, a charger roller 8 of a so-called contact type is rotatably attached to the frame 12. The charger roller 8 comprises a roller shaft 8*a*, an elastic conductive layer around the roller shaft, an elastic high resistive layer around the conductive layer, and a protection layer around the resistive layer. The elastic conductive layer is formed from elastic rubber such as EPDM, NBR dispersing carbon powder therein, and acts to transmit the bias voltage applied to the roller shaft 8*a*. The elastic high resistive layer is formed from urethane including a small amount of conductive fine powder and serves to limit the leak current to the photosensitive drum 7 thereby preventing the abrupt reduction of the bias voltage even if a charger roller having the high conductivity such as a pin hole is opposed to the photosensitive drum. Further, the protection layer is formed from N-methyl methoxyl nylon and serves to prevent the deterioration of the surface of the photosensitive drum 7 due to the contact between the drum and the plastic material of the elastic conductive layer and the elastic high resistive layer.

The charger roller 8 is contacted with the photosensitive drum, and when the image forming operation is effected, the charger roller is rotatingly driven by the rotation of the photosensitive drum 7 while applying the overlapped AC current and AC current to the charger roller 8, thereby uniformly charging the surface of the photosensitive drum 7.

(Exposure Station)

The exposure station 9 serves to form an electrostatic latent image on the photosensitive drum 7 by illuminating the uniformly charged photosensitive drum with the image light emitted from the optical system 1, and has an exposure opening 9 formed in the cartridge frame 12 for directing the image light.

(Developing Means)

As shown in FIG. 2, the developing means 10 has a toner reservoir 10*a* for containing the toner and a toner feeding member 10*b* disposed in the toner reservoir 10*a* and rotated in a direction shown by the arrow to feed out the toner. Further, the developing means has a developing sleeve 10*d* having a magnet 10*c* therein and rotated to form a thin toner layer thereon. The developing sleeve is opposed to the photosensitive drum 7 with a small gap therebetween. When the toner layer is formed on the developing sleeve 10*d*, a frictional charge sufficient to develop the electrostatic latent image on the photosensitive drum 7 can be obtained by the friction between the toner and the developing sleeve 10*d*. Further, a developing blade 10*e* is provided for regulating a thickness of the toner layer.

(Cleaning Means)

As shown in FIG. 2, the cleaning means 11 comprises a cleaning blade 11*a* contacted with the surface of the photosensitive drum 7 for scraping the residual toner remaining on the drum 7, a dip sheet 11*b* disposed below the cleaning blade 11*a* and lightly contacted with the photosensitive drum 7 and adapted to receive the toner scraped from the drum by the blade, and a waste toner reservoir 11*c* for collecting the waste toner received by the dip sheet.

By the way, when the toner contained in the process cartridge B according to the illustrated embodiment is used up or consumed completely, the process cartridge is collected, and the re-usable parts of the cartridge are recycled. To this end, in the illustrated embodiment, there is provided an information means for informing the number of usages of the function parts.

Recycling Procedure for Process Cartridge

Now, prior to the explanation of the information means for informing the number of usages of the function parts, the recycling procedure for the process cartridge will be explained.

The recycling procedure includes (1) collection, (2) assortment, (3) decomposition, (4) discrimination, (5) cleaning, (6) check, and (7) re-assembling.

(1) Collection:

The used process cartridges are collected to a collection center with the aid of the users and servicemen.

(2) Assortment:

The used process cartridges collected to the various collection centers are transported to recycling factories. The collected process cartridges are assorted in accordance with the types thereof.

(3) Decomposition:

The assorted process cartridges are decomposed and are gathered.

(4) Discrimination:

The gathered parts are checked, and the parts are sorted into the re-usable parts and non re-usable parts which were damaged or the service lives of which were expired.

(5) Cleaning:

Only re-usable parts are cleaned to permit them to be reused as parts in new cartridges.

(6) Check:

The cleaned parts are checked as to whether the functions thereof are restored or not and whether such parts can be reused or not.

(7) Re-assembling:

The parts passing the check, or new parts, are re-assembled in new process cartridges.

Now, according to the above procedure, as an example, the recycling of the charger roller and the transfer roller as the re-usable function parts will be concretely explained.

Incidentally, among the above procedure, (1) collection, (2) assortment, (3) decomposition, and (7) re-assembling are omitted from explanation since they are the same as the aforementioned ones.

First of all, the manner in which the charger roller and the transfer roller are checked and it is discriminated whether they can be reused or they cannot be reused because of damage or expiration of the service life will be explained.

The check in the discrimination procedure is effected by the operator's visual check or by using the number of reproductions obtained from the information means used in an embodiment which will be described later. The visual check is effected by visually comparing the part to be checked with a "sample table showing the limit of the damage of roller" by the operator. If the damage of the checked roller is greater than the "sample table showing the limit of the damage of roller", it is judged that the checked roller is not suitable to re-use; whereas, if the damage of the checked roller is greater than the "sample table showing the limit of the damage of roller", it is judged that the checked roller can be reused.

Next, the cleaning of the charger roller and transfer roller passing the check will be explained. Incidentally, the inventors have proposed a roller cleaning machine which can effectively clean rollers such as charger roller, transfer roller and the like (refer to the Japanese Patent Application No. 4-194985 filed on Jun. 29, 1992 corresponding to Japanese Patent Application Laid-Open No. 6-19370 published on Jan. 28, 1994). Thus, regarding the cleaning of the charger roller and transfer roller, an example that such roller cleaning machine is used will be described.

Figure 3:
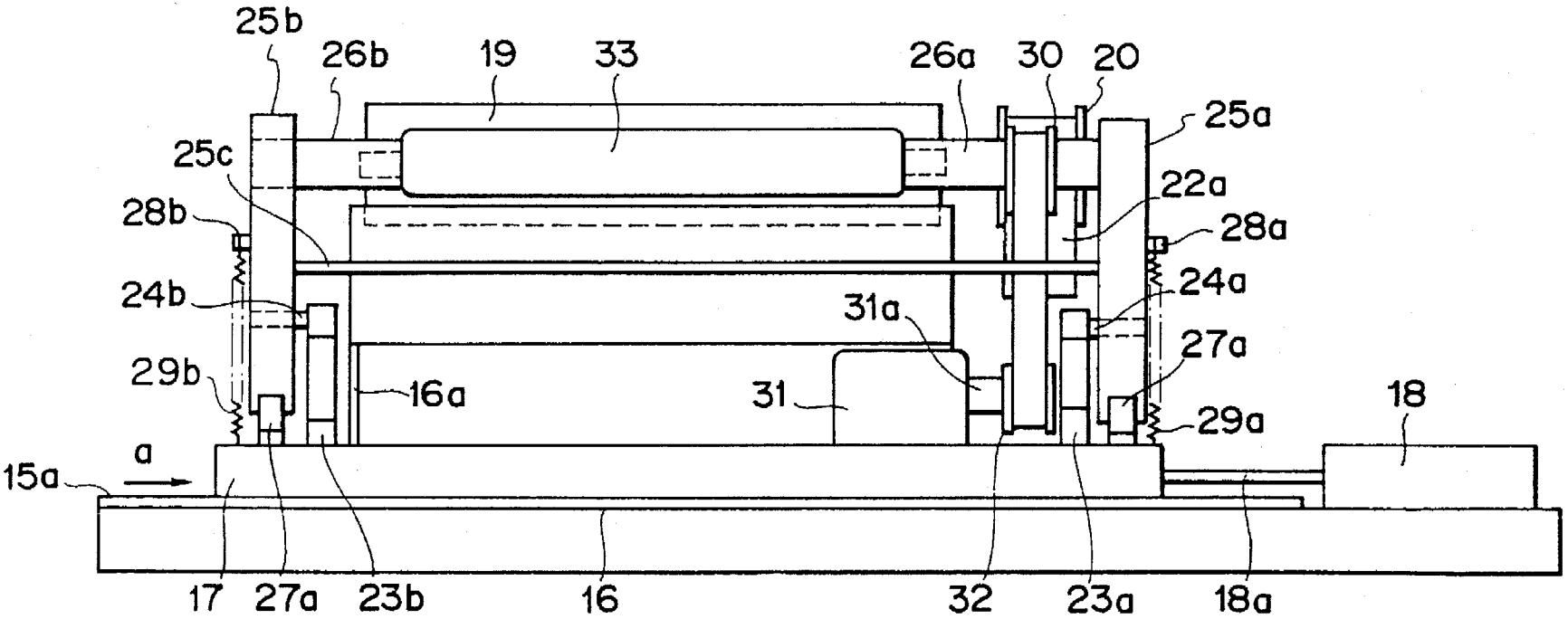
FIG. 3 is a front view of a roller cleaner.
Figure 4:
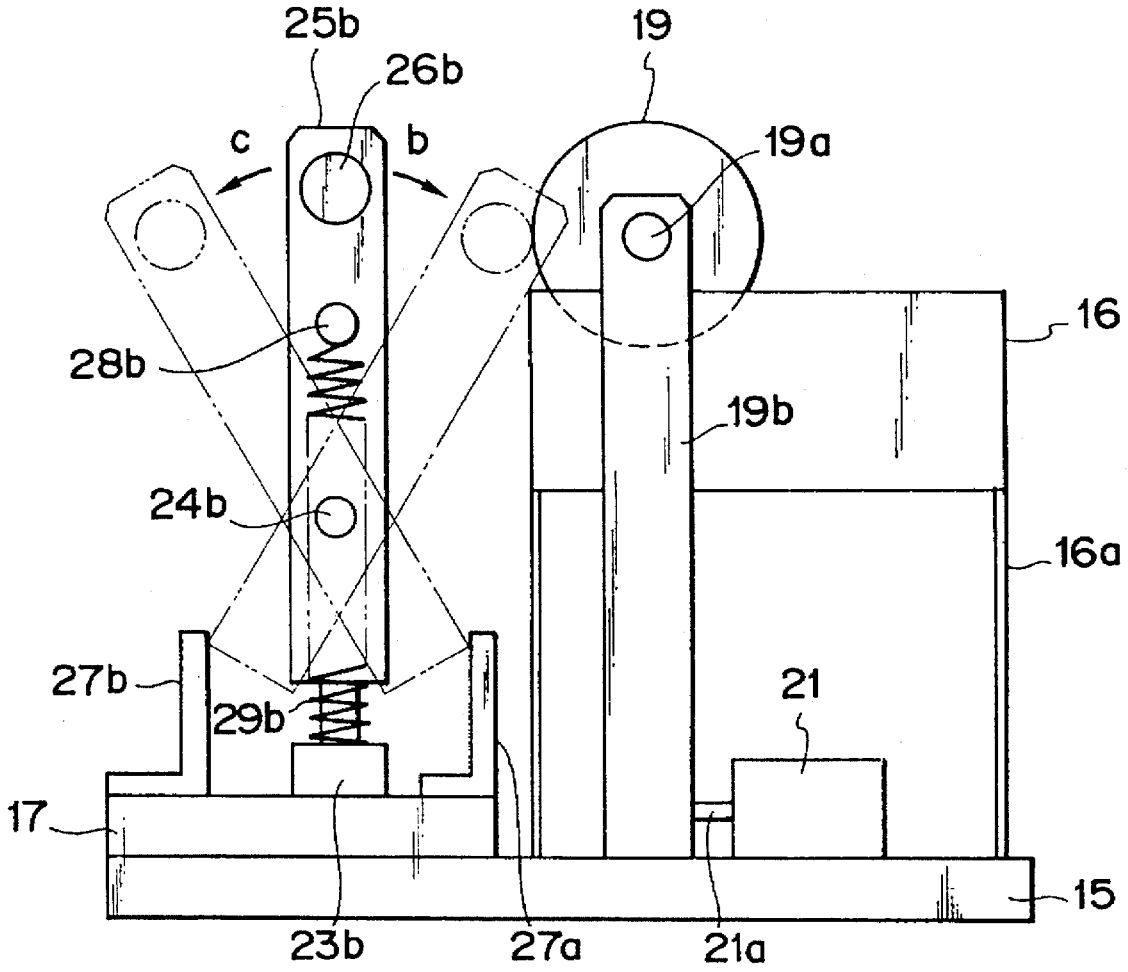
FIG. 4 is a side view of the cleaner of FIG. 3.

FIG. 3 is a front view of such roller cleaning machine, and FIG. 4 is an end view looked at from the arrow a in FIG. 3.

On a base 15, there is arranged a cleaning solvent bath 16 supported by a plurality of support legs 16*a* and adapted to contain cleaning solvent. Further, on the base, there is arranged a rocker plate 17 for pivoting guide rails 15*a* in a direction shown by the arrow a or in an opposite direction, substantially in parallel with the cleaning solvent bath 16. One end surface of the rocker plate 17 is connected to a piston rod 18*a* of a cylinder 18 secured to the base 15.

Upper portions of a pair of cleaning roller supporting posts 19*b* uprightly mounted on the base 15 on both sides of the cleaning solvent bath 16 are protruded above the upper surface of the bath 16, and a roller shaft 19*a* of a cleaning roller 19 is rotatably supported by the upper end portions of the posts 19*b*. The diameter and longitudinal length of the cleaning roller 19 are selected so that at least a portion of the outer peripheral surface of the cleaning roller 19 is contacted with the cleaning solvent in the bath 16. Further, a belt 22*a* extends between and is wound around a pulley 20 secured to the roller shaft 19*a* and a pulley (not shown) secured to an output shaft 21*a* of a cleaning roller motor 21.

On the other hand, a pair of struts 23*a*, 23*b* uprightly mounted on both longitudinal end portions of the rocker plate 17 rotatably support rocking members 25*a*, 25*b* via rotary shafts 24*a*, 24*b*, respectively. Both rocking members 25*a*, 25*b* are interconnected by a connecting rod 25*c*. A drive shaft 26*a* is rotatably supported by an upper portion of the rocking member 25*a*, and a rotary shaft 26*b* is rotatably supported by an upper portion of the rocking member 25*b* for axial movement. Thus, the pair of rocking members 25*a*, 25*b* can be integrally rocked around the respective rotary shafts 24*a*, 24*b* until lower ends of the members are abutted against a pair of stoppers 27*a*, 27*b* (up to positions shown by the phantom lines).

Further, tension springs 29*a*, 29*b* are connected between the rocker plate 17 and pins 28*a*, 28*b* formed on the rocking members above the rotary shafts 24*a*, 24*b*, respectively. Thus, when the pair of the rocking members 25*a*, 25*b* are rotated in the direction shown by the arrow b in FIG. 4, the tension springs 29*a*, 29*b* generate the spring force directing to the same direction; whereas, when the pair of the rocking members 25*a*, 25*b* are rotated in the direction shown by the arrow c in FIG. 4, the tension springs 29*a*, 29*b* generate the spring force directing to the same direction c. Further, a belt 22*b* extends between and is wound around a pulley 30 secured to the drive shaft 26*a* and a pulley 32 secured to the output shaft 31*a* of the cleaning roller motor 31.

Next, the operation of the cleaning machine will be explained.

First of all, when the pair of rocking members 25*a*, 25*b* are rotated in the direction c in FIG. 4, under the influence of the tension spring 29b, the lower ends of the rocking members 25a, 25b are abutted against the stoppers 27a. In this condition, the rotary shaft 26b is shifted in the axial direction, and shaft portions protruded from the roller to be cleaned are mounted between the drive shaft 26a and the rotary shaft 26b.

Then, the pair of rocking members 25a, 25b are rotated in the direction b, thereby abutting the roller 33 to be cleaned against the cleaning roller 19. As a result, the rocking members 25a, 25b are subjected to the soring forces of the tension springs 29a, 29b to urge the rocking members toward the direction b with the predetermined pressure, thereby urging the roller 33 to be cleaned against the cleaning roller 19 with a predetermined force.

Thereafter, the cleaning roller motor 21 is activated to rotate the cleaning roller 19 and a motor 31 for the roller to be cleaned is activated to rotate the roller 33 to be cleaned in a direction opposite to that of the cleaning roller 19. In this way, the roller 33 to be cleaned is cleaned by the cleaning roller 19 while applying the cleaning solvent to the peripheral surface of the roller 33 due to the contact between the rollers 19 and 33. In this case, since at least a portion of the cleaning roller 19 is contacted with the cleaning solvent in the cleaning solvent bath 16, the cleaning roller 19 is contacted with the roller 33 with always holding new cleaning solvent, thereby cleaning the roller 33 effectively.

Further, in addition to the above rotation, the rocker plate 17 is rocked in the direction a and the opposite direction on the base 15 by means of the cylinder 18, thereby shifting the roller 33 in the axial direction with respect to the cleaning roller 19. In this way, the cleaning efficiency is further improved.

Incidentally, the relation between the rotational directions of the cleaning roller 19 and the roller 33 to be cleaned are the following three:

(i) cleaning roller normal rotation/cleaned roller normal rotation, (ii) cleaning roller normal rotation/cleaned roller reverse rotation, and (iii) cleaning roller stop/cleaned roller normal rotation.

As a result of the investigation of the above combinations, it was found that, in order to remove the contamination of the roller 33 to be cleaned, (ii) and (iii) were suitable, but (i) was unsuitable to remove the contamination and a large amount of the contamination was remained. Further, as a result of the investigation of the kinds of cleaning members, it was found that the cleaning member coated on the cleaning roller requires that it does not damage or wear the roller to be cleaned and it is not melted, swelled or hardened regarding the cleaning solvent and it can absorb and hold the cleaning solvent adequately.

The material satisfying the above items may be synthetic resin foam, felt, synthetic resin brush or the like. The synthetic resin foam may be polyethylene foam, polyurethane foam or silicone foam; however, more preferably, polyethylene foam or polypropylene foam having the durability to the cleaning solvent is used as the synthetic resin foam. Further, the felt may be nylon felt, polyester felt polypropylene, elongated wool felt or the like; however, more preferably, nylon felt or polypropylene foam having the durability to the cleaning solvent is used as the felt. Further, the synthetic resin brush may be formed from brush wires made of polypropylene or nylon; however, a nylon brush is more preferable in the point that it has the durability to the cleaning solvent and has the rigidity against the bending.

On the other hand, various organic solvents can be used as the cleaning solvent alone or in combination. Further, detergent such as surface-active agent, inorganic acid, organic acid, alkali or abrasives may be mixed with the cleaning solvent, so long as the surface of the roller to be cleaned is not melted, damaged or swollen.

In the above-mentioned cleaning machine, while an example that a pair of rocking members 25a, 25b and the tension springs 29a, 29b connected to the rocking members are used as shifting means for shifting the cleaned roller supporting means for urging the cleaned roller 33 against the cleaning roller 19 with a predetermined pressure was explained, the present invention is not limited to this example, but the rocking members may be driven by hydraulic cylinders or the like. Further, the rocker plate 17 may be omitted; however, when the rocker plate 17 is used, it may be rocked by a reversible motor via a rack/pinion connection. Further, instead of having the cleaning roller contacted with the cleaning solvent in the cleaning solvent bath, the cleaning solvent may be sprayed from a nozzle on the cleaning roller or the cleaning solvent may be applied to the cleaning roller via an intermediate supply roller contact with the cleaning solvent source.

According to the above-mentioned cleaning machine, the charger roller and transfer roller (as roller to be cleaned) can be cleaned very easily and effectively.

Next, a rest result that the charger roller and transfer roller were cleaned by the cleaning machine will be explained. First of all, the test result regarding the charger roller will be described. A charger roller of a process cartridge used with a laser beam printer (Laser Shot LBP-A404 manufactured by Canon Co., Ltd.) was cleaned by the above-mentioned roller cleaning machine. The charger roller was collected from the process cartridge by which 3,200 copies was obtained. It was ascertained that the powder developer (toner) was adhered on the surface of the collected charger roller (Incidentally, the surface layer of the charger roller was formed from polyamide resin, and the outer diameter of the roller was 12 mm). The cleaning condition was as follows:

Cleaning solvent: methyl ethyl ketone (MEK);

Cleaning roller: outer diameter of 60 mm (including cleaning member, and core is made of SUS 304);

Cleaning member: nylon felt;

Roller RPM: cleaning roller stop roller to be cleaned (charge roller) 90 rpm;

Cleaning time: 15 seconds.

After the cleaning, it was visually ascertained that the toner was not adhered to the surface of the charger roller.

Next, the test result regarding the transfer roller will be described. A polyurethane foam roller (having an outer diameter of 18 mm) was used as a transfer roller of a transfer device of a laser beam printer (Laser Shot LBP-A404 manufactured by Canon Co., Ltd.). After 120,000 copies were obtained, such transfer roller was cleaned by the above-mentioned roller cleaning machine. It was ascertained that the toner was adhered on the surface of the transfer roller. The cleaning condition was as follows:

Cleaning solvent: isopropyl alcohol;

Cleaning roller: outer diameter of 60 mm (including cleaning member);

Cleaning member: roller-shaped nylon brush (wire diameter 0.8 mm);

Roller RPM: cleaning roller 120 rpm (normal) roller to be cleaned (transfer roller) 90 rpm (reverse);

Cleaning time: 20 seconds.

After the cleaning, it was visually ascertained that the toner was not adhered to the surface of the transfer roller.

Next, a method for checking whether the cleaned charger roller and transfer roller have the restored functions sufficiently and can be reused or not will be explained. The operator effects the following check or examination:

(1) Measurement of Outer Diameter of Roller by Scale:

A diameter of each roller is measured at both of its end portions and a central portion by a scale. In this case, if the measured diameter value is out of a standard or rated range, it is judged that the roller is not suitable to be reused; whereas, if the measured value is within the standard range, it is judged that the roller can be reused.

(2) Measurement of Roughness of Surface of Roller:

A surface roughness of each roller is measured under "ten-point average roughness" (Rz) (JIS B0601) by using a surface roughness measuring device (for example, "Surf Corder SE-30H" manufactured by Kosaka Kenkyusho, in Japan). In this case, if the measured value is out of a standard or rated range, it is judged that the roller is not suitable to be reused; whereas, if the measured value is within the standard range, it is judged that the roller can be reused.

(3) Measurement of Hardness of Roller:

Hardness of each roller is measured at both of its end portions and a central portion by a rubber hardness meter. In this case, if the measured value is out of a standard or rated range, it is judged that the roller is not suitable to be reused; whereas, if the measured value is within the standard range, it is judged that the roller can be reused.

(4) Measurement of Voltage Durability of Roller:

The presence/absence of the leak by applying a voltage to each roller is ascertained, thereby checking whether the roller is damaged or not. If the leak is ascertained, it is judged that the roller is not suitable to be reused; whereas, if the leak is not ascertained it is judged that the roller can be reused.

Next, the concrete test result regarding the above check will be described. First of all, the check result regarding the charger roller will be explained. Current values regarding a new charger roller (not yet used), a charger roller (after 3,200 copies was obtained) before cleaned, and a charger roller after cleaning were measured, respectively. The measurement of the current value was effected by abutting an aluminium drum (having an outer diameter of 30 mm) against the charger roller with a pressure of 500 g and by applying a voltage obtained by overlapping AC voltage Vpp of 500 V having frequency of 350 Hz with DC voltage of −200 V, and by measuring the direct current value and the alternate current value (under the measuring environment of 23° C., 60%RH).

| | DC value | AC value |
|---|---|---|
| New charger roller (non-used): | 180 μA | 220 μA |
| Charger roller before cleaning: | 60 μA | 140 μA |
| Charger roller after cleaning: | 170 μA | 210 μA |

As a result of the measurement of the current values, it was ascertained that the current value of the charger roller after cleaning was restored to a level of the current value of the new roller.

Next, the check result regarding the transfer roller will be explained. Electric resistance values regarding a new transfer roller (not yet used), a transfer roller (after 120,000 copies were obtained) before cleaning, and a transfer roller after cleaning were measured, respectively. The measurement of the electric resistance value was effected by abutting an aluminum drum (having an outer diameter of 30 mm) against the transfer roller with a pressure of 500 g and by applying a DC voltage of 2000 V and by measuring the current value to determine the resistance value (under the measuring environment of 23° C., 60%RH).

| | Resistance value |
|---|---|
| New transfer roller (non-used): | $8 \times 10^9\ \Omega$ |
| Transfer roller before cleaning (smudged): | $2 \times 10^{10}\ \Omega$ |
| Transfer roller after cleaning: | $7 \times 10^9\ \Omega$ |

As a result of the measurement of the resistance values, it was ascertained that the resistance value of the transfer roller after cleaning was restored to a level of the resistance value of the new roller.

Information Means for Informing Number of Usages of Function Parts

The process cartridge according to the illustrated embodiment is to be reused. That is, the first and second frames 12a, 12b are separated from each other by using a tool, and a charger roller 8 and a developing device 10 and the like are dismounted from the cartridge, and, if the service life of any part is not yet expired, such part is reproduced in accordance with the above-mentioned procedure to be reused. To this end, parts to be reproduced are associated with information means for informing the number of usages of such parts. Incidentally, the information means is preferably provided on the part after it was ascertained that the check of such part was passed in the above-mentioned check step (6).

Figure 5:
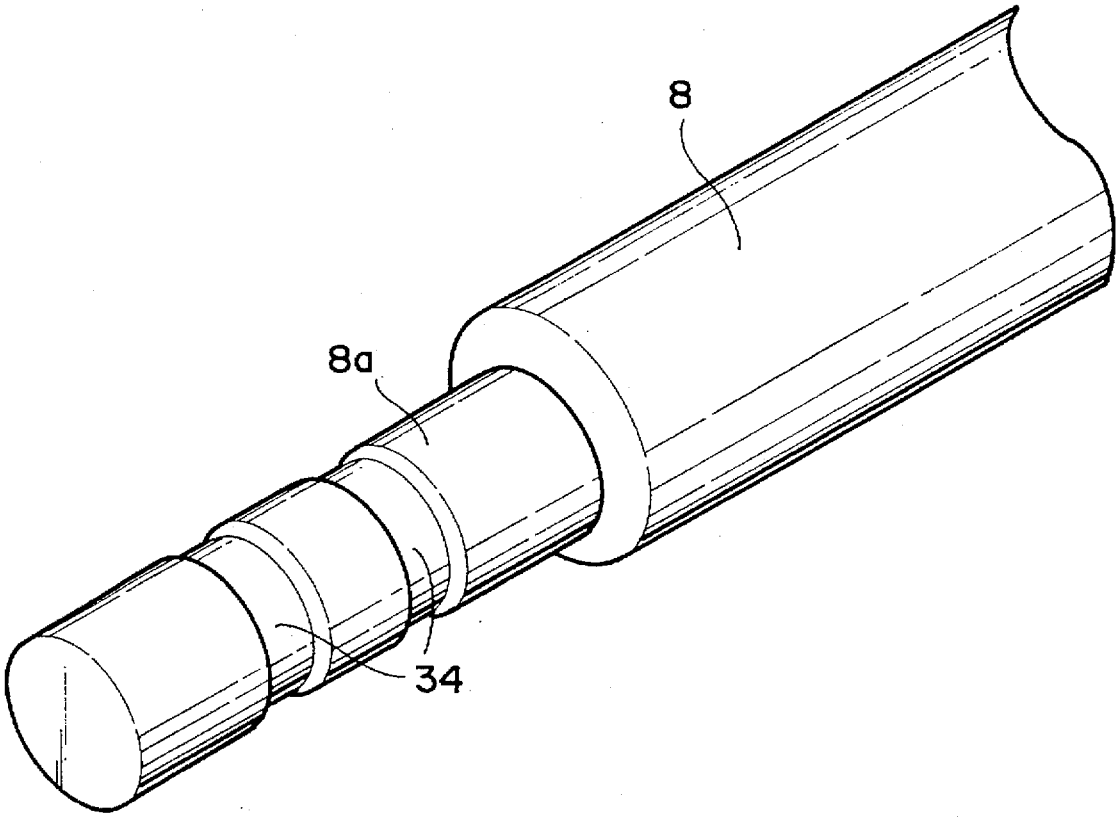
FIG. 5 is a perspective view showing a recycle number informing means comprising annular grooves formed on an peripheral surface of a roller shaft.

Next, the information means for informing the number of usages will be explained. First of all, the information means for the charger roller 8 will be described. When the charger roller 8 is to be reproduced for recycling, as shown in FIG. 5, an annular groove 34 is formed on the outer peripheral surface of the roller shaft 8a of the charger roller 8 by a lathe or drill whenever the charger roller is reproduced; such groove or grooves constitutes the information means for informing the number of usages of the charger roller.

When the information means is provided on a roller such as the charger roller, as mentioned above, such means is preferably formed on a roller shaft of such roller. Because when the part is a rubber roller, the roller barrel portion determines the outer diameter, hardness, electric feature and slidability of the roller and is contacted with other roller, photosensitive drum and recording medium 2. Thus, if the information means is formed on the roller barrel portion, any function(s) of the roller is deteriorated or the information means is erased due to the contact between the roller and other parts. Accordingly, when the information means is formed on the roller, it is desirable that it is formed on the roller shaft.

That is to say, while the number of reproductions of the roller can be checked by writing the number of reproduction, for example, on the image forming apparatus, in such a case, it is feared that the number of reproductions of the roller cannot be checked after the roller has been disassembled from the apparatus or process cartridge. Thus, in the case of parts such as rollers, it is desirable that the number of reproductions of the part can be easily determined by the part itself. Further, when the information means is provided on the roller shaft, it is desirable that such information means is formed on a portion of the roller shaft where a bearing or a gear is mounted on the shaft, because it is feared that the information means is worn by the friction between the roller shaft and the bearing or the information means cannot be easily found because of the fact that the information means is filled with the lubricant (oil, grease) for the gear.

To avoid this, in the illustrated embodiment, as mentioned above, the groove(s) 34 is formed, by the lathe or drill, on a portion of the roller shaft 8*a* of the charger roller 8 other than portions where the bearing and gear are mounted.

Figure 6:
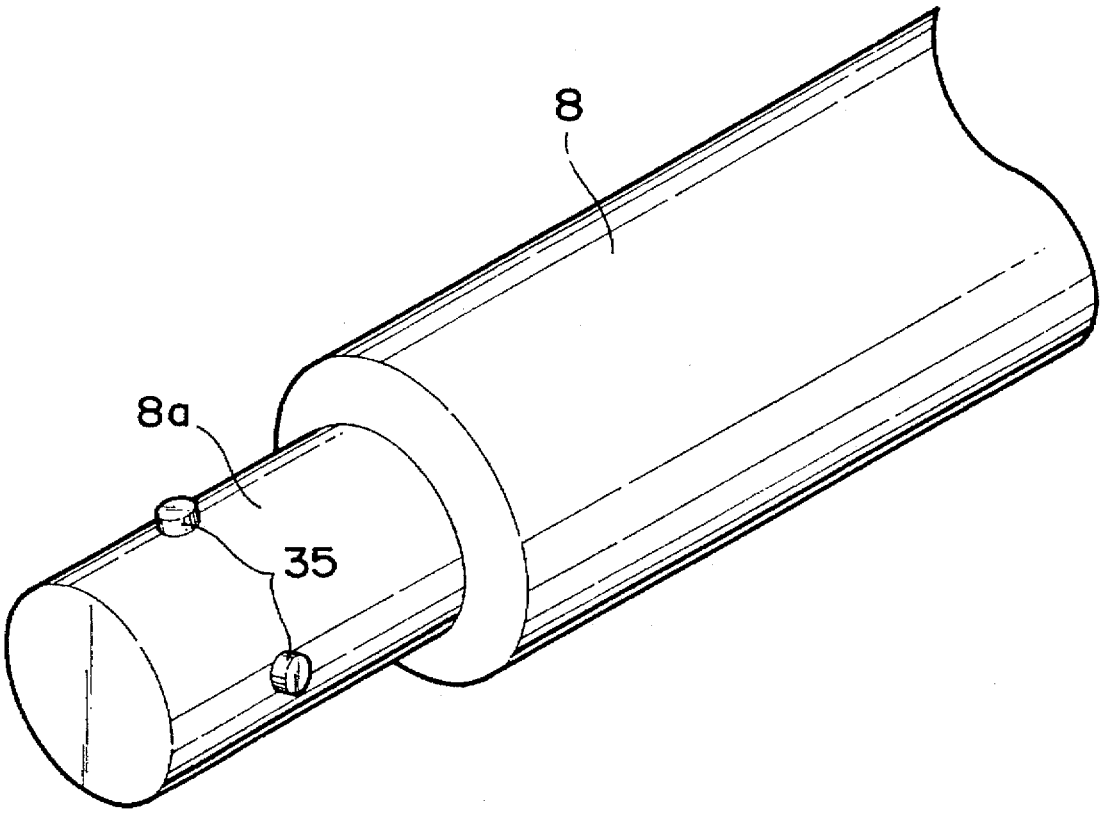
FIG. 6 is a perspective view showing an embodiment wherein projections are formed on a roller shaft.

Incidentally, if the information means is constituted by a protruded portion such as coating, since such protruded portion may be erased or worn due to the friction between the protruded portion and other part, it is desirable that the information means is constituted by the groove(s). However, the information means is not limited to the above-mentioned groove, but, the information means may be formed by painting a mark in consideration of the material of the paint and the painting position. In this case, the number of reproductions may be informed by a kind of color of the paint. Further, as shown in FIG. 6, a plurality of projections 35 may be previously formed on the roller shaft, and one projection 35 may be removed whenever the roller is reproduced.

After a groove 34 having a width of 0.2 mm and a depth of 0.05 mm was formed in the peripheral surface of the charger roller shaft 8*a* as the information means and the charger roller was incorporated into the process cartridge and the image forming operation was effected, it was found that the poor image could not be generated due to the roller shaft 8*a* even after 3,200 copies were obtained. Further, after the image forming operation, when the charger roller 8 was disassembled from the cartridge and the groove 34 as the information mark formed in the roller shaft 8*a* was checked, it was found that the configuration of the groove was unchanged.

Next, a second embodiment of the present invention will be explained.

In the above-mentioned first embodiment, while an example that the information means for informing the number of usages is formed on the roller shaft 8*a* of the charger roller 8 was explained, such information means may be provided on one end surface of the roller shaft. Next, an example that the information means is provided on one end surface of a roller shaft of the transfer roller will be described as the second embodiment.

Figure 7A:
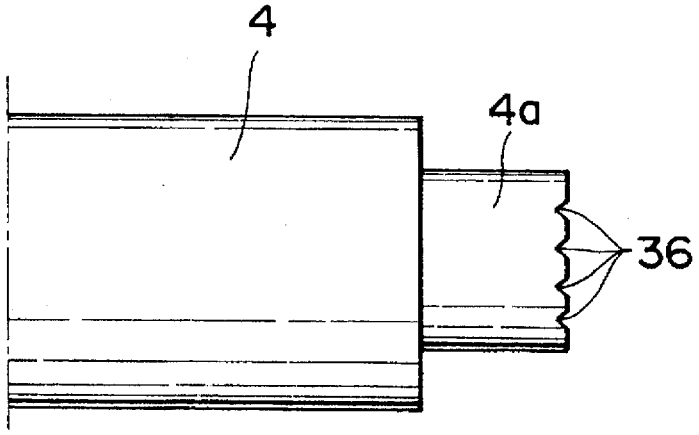
FIGS. 7A and 7B are views showing a recycle number informing means comprising concentric annular recesses formed on an end face of a roller shaft.
Figure 7B:
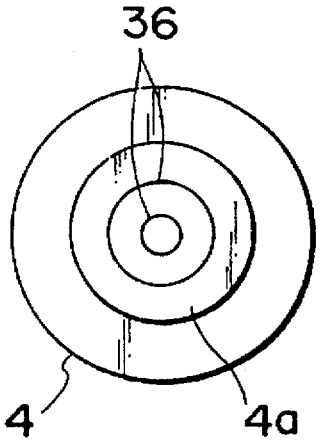

In this embodiment, as shown in FIGS. 7A and 7B, concentric annular grooves 36 are formed in one end surface of a roller shaft 4*a* of the transfer roller 4. Such groove 36 is formed on the end surface by a lathe or drill whenever the transfer roller is reproduced, as in the aforementioned first embodiment. Also in this case, since the end surface of the roller shaft is not contacted with a bearing and the like, the concentric grooves 36 as the information means are not worn.

After a groove 36 having a diameter of about 6 mm and a depth of 0.06 mm and a groove 36 having a diameter of about 3 mm and a depth of 0.03 mm were formed in the end surface of the transfer roller shaft 4*a* as the information means and the transfer roller 4 was incorporated into the process cartridge and the image forming operation was effected, it was found that the poor image could not be generated due to the roller shaft 4*a* even after 150,000 copies were obtained. Further, after the image forming operation, when the transfer roller 4 was disassembled from the cartridge and the grooves 36 as the information marks formed in the roller shaft 4*a* were checked, it was found that the configurations of the grooves 36 were unchanged. Incidentally, as mentioned above, the information means for informing the number of usage may be formed in an end surface of the roller shaft 8*a* of the charger roller 8. Also in this case, the annular grooves may be formed in the end surface of the roller shaft 8*a*, or synthetic resin paint may be coated on the end surface of the roller shaft. In the latter case, the synthetic resin paint preferably has a good coating ability, durability to medicines and durability to the voltage.

Lastly, other embodiments will be explained.

In the above-mentioned first embodiment, while the charger roller 8 and the transfer roller 4 were explained as the parts to be reproduced, it is apparent that the present invention is not limited to the charger roller 8 or the transfer roller 4, but may be applied to other rollers such as the cleaning roller and the convey roller for reproducing them. Accordingly, the present invention is not limited to an image forming apparatus having a process cartridge, but may be applied to any image forming apparatus having no process cartridge. That is to say, the present invention can be applied to a charger roller, developing sleeve, cleaning roller, transfer roller, fixing roller or convey roller.

Furthermore, the roller shaft is not limited to metal such as iron, brass or the like, but may be formed from hard plastic, for example. Further, the roller may be fixedly secured to the roller shaft or may be rotatably mounted on the roller shaft so long as the roller shaft is aligned with a central axis of the roller.

The process cartridge B according to the present invention can be applied to a case where a plural-color image (two-color image, three-color image or full-color image) is formed by a plurality of developing means 10, as well as the case where the mono-color image is formed as mentioned above.

Further, regarding the developing method, a conventional two-component magnetic brush method, cascade developing method, touch-down developing method or cloud developing method may be used.

Further, regarding the charger means, while the charger means of so-called contact type was used in the aforementioned first embodiment, it should be noted that the charger means may be constructed by three side walls formed from tangsten wires and a metal (such as aluminium) shield covering the side walls, whereby positive or negative ions generated by applying high voltage to the tangsten wires is transferred to the surface of the photosensitive drum 7, thereby uniformly charging the surface of the photosensitive drum 7.

Incidentally, the charger means may be of blade type (charger blade), pad type, block type, rod type or wire type, as well as the above-mentioned roller type.

Further, the above-mentioned process cartridge includes an electrophotographic photosensitive body as an image forming member, and at least one process means. Therefore, a process cartridge may integrally incorporate therein an image bearing member and a charger means as a unit which can be removably mounted within an image forming apparatus, or may integrally incorporate therein an image bearing member and a developing means as a unit which can be removably mounted within an image forming apparatus, or may integrally incorporate therein an image bearing member and a cleaning means as a unit which can be removably mounted within an image forming apparatus, or may integrally incorporate therein an image bearing member and two or more process means as a unit Which can be removably mounted within an image forming apparatus, as well as the above-mentioned cartridge.

That is to say, a process cartridge may integrally incorporate therein an image bearing member, and a charger means or a developing means or a cleaning means as a unit which can be removably mounted within an image forming apparatus, or integrally incorporate therein an image bearing member and at least one of a charger means, a developing means and a cleaning means as a unit which can be removably mounted within an image forming apparatus, or may integrally incorporate therein an image bearing member and at least a developing means as a unit which can be removably mounted within an image forming apparatus.

Further, in the aforementioned embodiments, while a laser beam printer was explained as the image forming apparatus, the present invention is not limited to the laser beam printer, but may be applied to other image forming apparatuses such as an LED printer, electrophotographic copying machine, facsimile system or word processor.

As mentioned above, according to the present invention, since the information means for informing the number of usages is formed on a shaft of a reusable part, even when the part is disassembled from the cartridge or apparatus, the number of usages of the part can easily be recognized, thus facilitating the reproducing operation. Further, when a roller is reused, since the information means is provided on the roller shaft, it is possible to prevent the information means from wearing due to the reuse of the reproduced roller and prevent the function of the roller from deteriorating.

What is claimed is:

1. A process cartridge having at least one reusable part, including a shaft, and being mountable onto an image forming apparatus, said process cartridge comprising:

a frame;

process means provided on said frame for contributing to an image formation; and indicating means integrally formed with said shaft of said reusable part for indicating the number of usages of said reusable part, wherein said indicating means remains integral with said shaft after said process cartridge is disassembled.

2. A process cartridge according to claim 1, wherein said reusable part is a function part having a mechanical function for a predetermined time.

3. A process cartridge according to claim 1, wherein said reusable part is a function part having an electrical function for a predetermined time.

4. A process cartridge according to claim 1, wherein said reusable part is a function part having an optical function for a predetermined time.

5. A process cartridge according to claim 1, wherein said process means comprises a photosensitive drum which constitutes said reusable part.

6. A process cartridge according to claim 1, wherein said process means comprises a charger roller which constitutes said reusable part.

7. A process cartridge according to claim 1, wherein said process means comprises a developing roller which constitutes said reusable part.

8. A process cartridge according to claim 1, wherein said process means comprises a cleaning roller which constitutes said reusable part.

9. A process cartridge according to claim 1, wherein said shaft is a roller shaft and said indicating means is a cut groove formed in said roller shaft.

10. A process cartridge according to claim 1, wherein said shaft is a roller shaft and said indicating means is a cut-out formed in said roller shaft.

11. A process cartridge according to claim 1, wherein said shaft is a roller shaft and said indicating means is a painted portion coated on said roller shaft.

12. A process cartridge according to claim 1, wherein the process cartridge incorporates integrally therein an electrophotographic photosensitive member, and a charger means or a developing means or a cleaning means as a unit which can removably be mounted within said image forming apparatus.

13. A process cartridge according to claim 1, wherein the process cartridge incorporates integrally therein an electrophotographic photosensitive member, and at least one of a charger means, a developing means and a cleaning means as a unit which can removably be mounted within said image forming apparatus.

14. A process cartridge according to claim 1, wherein the process cartridge incorporates integrally therein at least one of an electrophotographic photosensitive member and a developing means as a unit which can removably be mounted within said image forming apparatus.

15. An image forming apparatus having at least one reusable part, including a shaft, and onto which a process cartridge can removably be mounted and which forms an image on a recording medium, said image forming apparatus comprising:

a mounting means for mounting a process cartridge including a frame, an image bearing member, and process means provided within said frame for contributing to an image formation;

indicating means integrally formed with said shaft of said reusable part for indicating the number of usages of said reusable part, wherein said indicating means remains integral with said shaft after said image forming apparatus is disassembled;

a transfer means for transferring an image formed on said image bearing member included in said process cartridge mounted on said mounting means onto the recording medium; and a convey means for conveying the recording medium.

16. An image forming apparatus according to claim 15, wherein said transfer means comprises a transfer roller which constitutes said reusable part.

17. An image forming apparatus according to claim 15, wherein said convey means comprises a convey roller which constitutes said reusable part.

18. An image forming apparatus according to claim 15, wherein the image forming apparatus is a laser beam printer.

19. An image forming apparatus according to claim 15, wherein the image forming apparatus is an LED printer.

20. An image forming apparatus according to claim 15, wherein the image forming apparatus is an electrophotographic copying machine.

21. An image forming apparatus according to claim 15, wherein the image forming apparatus is a facsimile apparatus.

22. An image forming apparatus for forming an image on a recording medium, said image forming apparatus having at least one reusable part, including a shaft, and comprising:

an image bearing means;

an image forming means for forming a latent image on said image bearing means;

a developing means for developing the latent image formed on said image bearing means as a toner image;

a transfer means for transferring the toner image formed on said image bearing means onto the recording medium;

a cleaning means for removing residual toner from said image bearing means;

a fixing means for fixing the toner image transferred to the recording medium by said transfer means to said recording medium;

a convey means for conveying the recording medium; and indicating means integrally formed with said shaft of said reusable part for indicating the number of usages of said reusable part, wherein said indicating means remains integral with said shaft after said image forming apparatus is disassembled.

23. An image forming apparatus according to claim 22, wherein said reusable part is a function part having a mechanical function for a predetermined time.

24. An image forming apparatus according to claim 22, wherein said reusable part is a function part having an electrical function for a predetermined time.

25. An image forming apparatus according to claim 22, wherein said reusable part is a function part having an optical function for a predetermined time.

26. An image forming apparatus according to claim 22, wherein said image bearing means comprises a photosensitive drum which constitutes said reusable part.

27. An image forming apparatus according to claim 22, wherein said charger means comprises a charger roller which constitutes said reusable part.

28. An image forming apparatus according to claim 22, wherein said developing means comprises a developing roller which constitutes said reusable part.

29. An image forming apparatus according to claim 22, wherein said transfer means comprises a transfer roller which constitutes said reusable part.

30. An image forming apparatus according to claim 22, wherein said fixing means comprises a fixing roller which constitutes said reusable part.

31. An image forming apparatus according to claim 22, wherein said cleaning means comprises a cleaning roller which constitutes said reusable part.

32. An image forming apparatus according to claim 22, wherein said convey means comprises a convey roller which constitutes said reusable part.

33. An image forming apparatus according to claim 22, wherein said shaft is a roller shaft and said indicating means is a cut groove formed in said roller shaft.

34. An image forming apparatus according to claim 22, wherein said shaft is a roller shaft and said indicating means is a cut-out formed in said roller shaft.

35. An image forming apparatus according to claim 22, wherein said shaft is a roller shaft and said indicating means is a painted portion coated on said roller shaft.

36. An image forming apparatus according to claim 22, wherein the image forming apparatus is a laser beam printer.

37. An image forming apparatus according to claim 22, wherein the image forming apparatus is an LED printer.

38. An image forming apparatus according to claim 22, wherein the image forming apparatus is an electrophotographic copying machine.

39. An image forming apparatus according to claim 22, wherein the image forming apparatus is a facsimile apparatus.

40. A process cartridge removably mountable onto a main body of an image forming apparatus, said process cartridge comprising:

a cartridge frame;

an electrophotographic photosensitive drum rotatably attached to said cartridge frame; and a charge roller for charging said electrophotographic photosensitive drum, said charge roller being rotatably attached to said cartridge frame and having an elastic layer disposed around a metallic roller shaft thereof, wherein an indicating mark is provided directly on said roller shaft of said charge roller for indicating a number of usages of said charge roller.

41. A process cartridge according to claim 40, wherein said indicating mark is a coating material coated on said roller shaft.

42. A process cartridge according to claim 41, wherein one or more of said indicating marks are sequentially added to said roller shaft.

43. A process cartridge according to claim 42, wherein said elastic layer has a first resilient layer of conductive material disposed about said roller shaft, and a second resilient layer of high resistance disposed about said first resilient layer and having a protection layer on a surface thereof.

44. A process cartridge according to claim 43, wherein said first resilient layer is made of a rubber layer in which carbon is dispersed, said second resilient layer is made of a rubber layer in which a very small amount of conductive particles is contained, and said protection layer is made of a nylon material.

45. A process cartridge according to claim 43, further comprising a developing roller for developing a latent image formed on said electrophotographic photosensitive drum, and a cleaning blade for removing toner remaining on said electrophotographic photosensitive drum.

46. A process cartridge according to claim 40, wherein one or more of said indicating marks are sequentially added to said roller shaft.

47. A process cartridge according to claim 46, wherein said elastic layer has a first resilient layer of conductive material disposed about said roller shaft, and a second resilient layer of high resistance disposed about said first resilient layer and having a protection layer on a surface thereof.

48. A process cartridge according to claim 47, wherein said first resilient layer is made of a rubber layer in which carbon is dispersed, said second resilient layer is made of a rubber layer in which a very small amount of conductive particles is contained, and said protection layer is made of a nylon material.

49. A process cartridge according to claim 47, further comprising a developing roller for developing a latent image formed on said electrophotographic photosensitive drum, and a cleaning blade for removing toner remaining on said electrophotographic photosensitive drum.

50. A process cartridge according to claim 40, wherein said elastic layer has a first resilient layer of conductive material disposed about said roller shaft, and a second resilient layer of high resistance disposed about said first resilient layer and having a protection layer on a surface thereof.

51. A process cartridge according to claim 50, further comprising a developing roller for developing a latent image formed on said electrophotographic photosensitive drum, and a cleaning blade for removing toner remaining on said electrophotographic photosensitive drum.

52. A process cartridge according to claim 50, wherein said first resilient layer is made of a rubber layer in which carbon is dispersed, said second resilient layer is made of a rubber layer in which a very small amount of conductive particles is contained, and said protection layer is made of a nylon material.

53. A process cartridge according to claim 40, further comprising a developing roller for developing a latent image formed on said electrophotographic photosensitive drum, and a cleaning blade for removing toner remaining on said electrophotographic photosensitive drum.

54. A process cartridge removably mountable onto a main body of an image forming apparatus, said process cartridge comprising:

a cartridge frame;

an electrophotographic photosensitive drum rotatably attached to said cartridge frame;

a developing roller for developing a latent image formed on said electrophotographic photosensitive drum;

a cleaning blade for removing toner remaining on said electrophotographic photosensitive drum; and a charge roller for charging said electrophotographic photosensitive drum, said charge roller being rotatably attached to said cartridge frame and having an elastic layer disposed around a metallic roller shaft thereof, said elastic layer having a conductive first resilient layer provided around said roller shaft and a high resistance second resilient layer provided around said first resilient layer and having a protection layer on a surface thereof, wherein an indicating mark is provided directly on said roller shaft of said charge roller for indicating a number of usages of said charge roller, and wherein said indicating mark is provided on said roller shaft by coating a coating material on said roller shaft.

55. A process cartridge according to claim 54, wherein one or more of said indicating marks are sequentially added to said roller shaft.

56. A process cartridge according to claim 55, wherein said first resilient layer is made of a rubber layer in which carbon is dispersed, said second resilient layer is made of a rubber layer in which very a small amount of conductive particles is contained, and said protection layer is made of a nylon material.

57. A process cartridge according to claim 54, wherein said first resilient layer is made of a rubber layer in which carbon is dispersed, said second resilient layer is made of a rubber layer in which a very small amount of conductive particles is contained, and said protection layer is made of a nylon material.

58. A charge roller, used for a process cartridge including a cartridge frame and an electrophotographic photosensitive drum rotatably attached to the cartridge frame and being removably mountable onto a main body of an image forming apparatus, for charging the electrophotographic photosensitive drum, said charge roller comprising:

a metallic roller shaft; and an elastic layer provided around said roller shaft, said elastic layer having a conductive first elastic layer provided around said roller shaft, and a high resistance second elastic layer disposed around said first elastic layer and having a protection layer on a surface thereof, wherein an indicating mark is provided directly on said roller shaft for indicating a number of usages of said charge roller.

59. A charge roller according to claim 58, wherein said indicating mark is a coating material coated on said roller shaft.

60. A charge roller according to claim 59, wherein one or more of said indicating marks are sequentially added to said roller shaft.

61. A charge roller according to claim 60, wherein said first elastic layer is made of a rubber layer in which carbon is dispersed, said second elastic layer is made of a rubber layer in which a very small amount of conductive particles is contained, and said protection layer is made of a nylon material.

62. A charge roller according to claim 58, wherein one or more of said indicating marks are sequentially added to said roller shaft.

63. A charge roller according to claim 62, wherein said first elastic layer is made of a rubber layer in which carbon is dispersed, said second elastic layer is made of a rubber layer in which a very small amount of conductive particles is contained, and said protection layer is made of a nylon material.

64. A charge roller according to claim 58, wherein said first elastic layer is made of a rubber layer in which carbon is dispersed, said second elastic layer is made of a rubber layer in which a very small amount of conductive particles is contained, and said protection layer is made of a nylon material.

65. A charge roller, used for a process cartridge including a cartridge frame, an electrophotographic photosensitive drum rotatably attached to the cartridge frame, a developing roller for developing a latent image formed on the electrophotographic photosensitive drum, and a cleaning blade for removing toner remaining on the electrophotographic photosensitive drum, and being removably mountable onto a main body of an image forming apparatus, for charging the electrophotographic photosensitive drum, said charge roller comprising:

a metallic roller shaft; and an elastic layer provided around said roller shaft, said elastic layer having a conductive first elastic layer provided around said roller shaft, and a high resistance second elastic layer disposed around said first elastic layer and having a protection layer on a surface thereof, wherein an indicating mark is provided directly on said roller shaft for indicating a number of usages of said charge roller, said indicating mark being provided on said roller shaft by coating a coating material on said roller shaft.

66. A charge roller according to claim 65, wherein one or more of said indicating marks are sequentially added to said roller shaft.

67. A charge roller according to claim 66, wherein said first elastic layer is made of a rubber layer in which carbon is dispersed, said second elastic layer is made of a rubber layer in which a very small amount of conductive particles is contained, and said protection layer is made of a nylon material.

68. A charge roller according to claim 65, wherein said first elastic layer is made of a rubber layer in which carbon is dispersed, said second elastic layer is made of a rubber layer in which a very small amount of conductive particles is contained, and said protection layer is made of a nylon material.

* * * * *

UNITED STATES PATENT AND TRADEMARK OFFICE

CERTIFICATE OF CORRECTION

PATENT NO. : 5,691,807
DATED : November 25, 1997
INVENTOR(S) : Naoki FUEI, et al.

It is certified that error appears in the above-indentified patent and that said Letters Patent is hereby corrected as shown below:

Column 2, line 42, delete "re-usages" and insert therefor --re-usable--.

Column 3, line 34, delete "that".

Column 4, line 29, delete "if" and insert therefor --1f--.

Column 10, line 32, delete "was" and insert therefor --were--.

Column 11, line 36, delete "was" and insert therefor --were--; and delete "cleaned" and insert therefor --cleaning--.

Signed and Sealed this

Twelfth Day of May, 1998

Bruce Lehman

*Attest:*

BRUCE LEHMAN

*Attesting Officer*

*Commissioner of Patents and Trademarks*